US011337480B2

(12) United States Patent
Lakes et al.

(10) Patent No.: US 11,337,480 B2
(45) **Date of Patent: *May 24, 2022**

(54) BICYCLE HELMET FIT SYSTEM

(71) Applicant: Specialized Bicycle Components, Inc., Morgan Hill, CA (US)

(72) Inventors: Robert Lakes, San Jose, CA (US); David E. Stroud, Soquel, CA (US); Michael Grim, Aptos, CA (US); Mike Krynock, Morgan Hill, CA (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 269 days.

This patent is subject to a terminal disclaimer.

(21) Appl. No.: 16/578,581

(22) Filed: Sep. 23, 2019

(65) Prior Publication Data

US 2020/0085129 A1 Mar. 19, 2020

Related U.S. Application Data

(63) Continuation of application No. 14/262,388, filed on Apr. 25, 2014, now Pat. No. 10,420,385.

(51) Int. Cl.

| | |
|---|---|
| ***A42B 3/06*** | (2006.01) |
| ***A42B 3/14*** | (2006.01) |
| ***A42B 3/08*** | (2006.01) |

(52) U.S. Cl.

CPC ..... *A42B 3/066* (2013.01); *A42B 3/142* (2013.01); *A42B 3/145* (2013.01); *A42B 3/08* (2013.01)

(58) Field of Classification Search

CPC .. A42B 1/22; A42B 3/066; A42B 3/14; A42B 3/142; A42B 3/147; A42B 3/08; A42B 3/085

(Continued)

(56) References Cited

U.S. PATENT DOCUMENTS

90 A * 11/1836 Greenleaf ..... A42B 1/22 2/173.5

2,205,742 A 6/1940 Bowers (Continued)

FOREIGN PATENT DOCUMENTS

EP 937416 A2 8/1999
EP 1607012 A1 12/2005

(Continued)

OTHER PUBLICATIONS

Translation of WO2014023005, Cheh, Chin-Chu, Helmet Buckling Band Structure, Feb. 13, 2014, Translated via Google (Year: 2014).*

(Continued)

*Primary Examiner* — Heather Mangine

(74) *Attorney, Agent, or Firm* — Micheal Best & Friedrich LLP

(57) ABSTRACT

The present invention provides a helmet comprising a main body having a concave interior for receiving a user's head, a head strap coupled to the body, and an adjustment mechanism coupled to the head strap. The head strap is positioned in a loop that spans at least 1.5 wraps around the interior of the main body. Preferably, the head strap is fully recessed into the concave interior of the main body. The head strap can include an occipital pad and a flexible belt (e.g., two flexible belts) secured to the occipital pad and engaged with the adjustment mechanism. Preferably, at least a portion of the flexible belt is spaced rearward from the occipital pad. The helmet can further include a belt guide (e.g., two side belt guides and a front belt guide) secured to the main body and adapted to allow the head strap to slide through the belt guide.

6 Claims, 6 Drawing Sheets

(58) Field of Classification Search
USPC ..... 2/418, 417, 421
See application file for complete search history.

(56) References Cited

U.S. PATENT DOCUMENTS

| | | | | | |
|---|---|---|---|---|---|
| 2,437,748 | A | | 3/1948 | Malcom | |
| 2,438,409 | A | * | 3/1948 | Malcom | A42B 3/145 2/8.1 |
| 2,739,310 | A | * | 3/1956 | Frieder | A42B 3/14 2/418 |
| 3,628,190 | A | * | 12/1971 | Molitoris | A42B 3/085 2/418 |
| 4,407,021 | A | * | 10/1983 | Kralik | A42B 3/14 2/416 |
| 4,453,277 | A | * | 6/1984 | Durand | A42B 3/14 2/416 |
| 4,888,831 | A | * | 12/1989 | Oleson | A42B 3/145 2/420 |
| 5,142,705 | A | * | 9/1992 | Edwards | A42B 3/145 2/183 |
| 5,477,563 | A | * | 12/1995 | Gentes | A42B 3/062 2/411 |
| 5,572,749 | A | * | 11/1996 | Ogden | A42B 3/14 2/410 |
| 5,815,847 | A | | 10/1998 | Holden, Jr. | |
| 5,893,174 | A | | 4/1999 | Primeau | |
| 5,983,405 | A | * | 11/1999 | Casale | A42B 3/145 2/417 |
| 6,401,261 | B1 | * | 6/2002 | Arney | A42B 3/085 2/421 |
| 6,865,752 | B2 | | 3/2005 | Udelhofen et al. | |
| 7,950,073 | B2 | * | 5/2011 | Ferrara | A42B 3/14 2/417 |
| 8,370,967 | B2 | * | 2/2013 | Chen | A42B 3/145 2/418 |
| 8,434,200 | B2 | | 5/2013 | Chen | |
| 9,743,701 | B2 | * | 8/2017 | Javorek | A42B 3/08 |
| 10,420,385 | B2 | * | 9/2019 | Lakes | A42B 3/066 |
| 2003/0115662 | A1 | * | 6/2003 | Dobbie | G02B 27/0176 2/422 |
| 2004/0117897 | A1 | * | 6/2004 | Udelhofen | A42B 3/324 2/421 |
| 2005/0204456 | A1 | * | 9/2005 | Piper | A42B 3/00 2/411 |
| 2005/0217006 | A1 | * | 10/2005 | Sutter | A42B 3/08 2/416 |
| 2010/0281604 | A1 | | 11/2010 | Grim et al. | |
| 2013/0239303 | A1 | * | 9/2013 | Cotterman | A42B 3/08 2/417 |
| 2013/0283507 | A1 | * | 10/2013 | Baty | A42B 3/064 2/416 |
| 2013/0312163 | A1 | * | 11/2013 | Van Waes | A42B 3/145 2/421 |
| 2016/0165998 | A1 | * | 6/2016 | Musal | A42B 3/063 2/417 |
| 2017/0006951 | A1 | * | 1/2017 | Venturini | A42B 3/145 |
| 2017/0347736 | A1 | * | 12/2017 | Penner | A42B 3/085 |
| 2018/0095497 | A1 | * | 4/2018 | Hsu | A61F 9/06 |
| 2018/0325203 | A1 | * | 11/2018 | Cotterman | A42B 3/06 |
| 2019/0196536 | A1 | * | 6/2019 | Wang | G06F 1/163 |

FOREIGN PATENT DOCUMENTS

| | | | | |
|---|---|---|---|---|
| EP | 2205112 | A2 | 7/2010 | |
| WO | 2006005183 | A1 | 1/2006 | |
| WO | 2014023005 | A1 | 2/2014 | |
| WO | WO-2014023005 | A1 * | 2/2014 | A42B 1/22 |

OTHER PUBLICATIONS

European Patent Office Extended Search Report for Application No. 07707324.3 dated Oct. 28, 2015 (8 pages).

* cited by examiner

BICYCLE HELMET FIT SYSTEM

CROSS-REFERENCE TO RELATED APPLICATIONS

This application is a continuation of U.S. application Ser. No. 14/262,388, filed Apr. 25, 2014, the entire contents of which are incorporated herein by reference.

BACKGROUND

The present invention relates generally to bicycle helmets, and particularly to a system for adjusting the size of the helmet in order to fit properly on a user.

Modern bicycle helmets typically include a hard foam shell covered with a hard plastic skin. On one type of helmet, the inside of the foam shell includes soft foam pads that can be interchanged with pads of different sizes in order to fit the helmet to the user. On another type of helmet, the inside of the foam shell is provided with an adjustable suspension system that can be sized to the user. The suspension system commonly includes an adjustable strap that is designed to fit around a user head to hold the helmet in place on the user's head.

SUMMARY

The present invention provides a helmet comprising a main body having a concave interior for receiving a user's head, a head strap coupled to the body, and an adjustment mechanism coupled to the head strap. The head strap is positioned in a loop that spans at least 1.5 wraps around the interior of the main body. For example, the head strap can overlap onto itself around at least 25% and preferably at least 50% of the interior of the main body. Preferably, the head strap is fully recessed into the concave interior of the main body.

In one embodiment, the head strap includes an occipital pad positioned at an occipital region of the main body and preferably coupled to the main body. The head strap can further include a flexible belt (e.g., two flexible belts) secured to the occipital pad and engaged with the adjustment mechanism. Preferably, at least a portion of the flexible belt is spaced rearward from the occipital pad. The helmet can further include a belt guide (e.g., two side belt guides and a front belt guide) secured to the main body and adapted to allow the head strap to slide through the belt guide.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
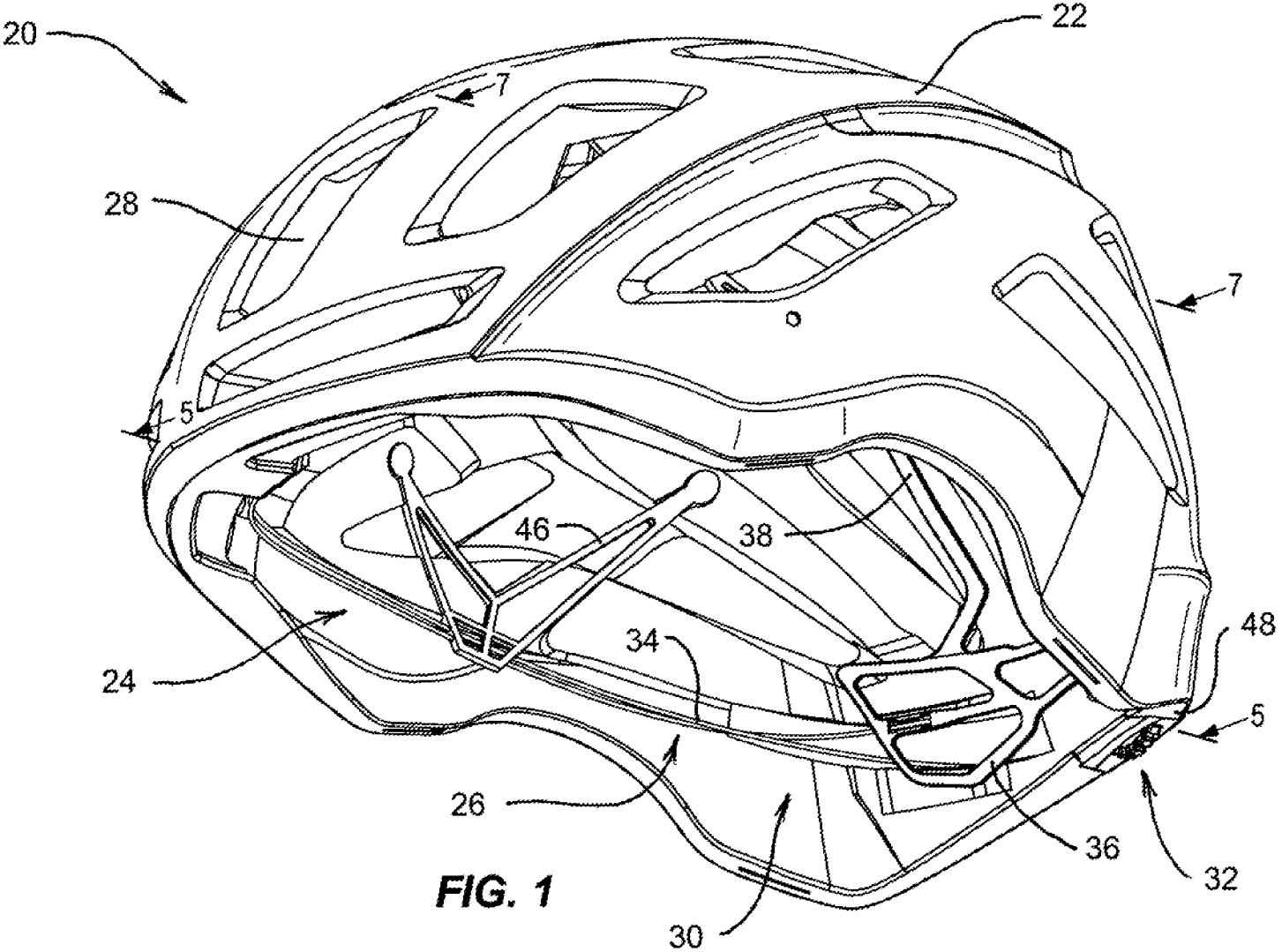
FIG. 1 is a perspective view of a helmet embodying the present invention.
Figure 2:
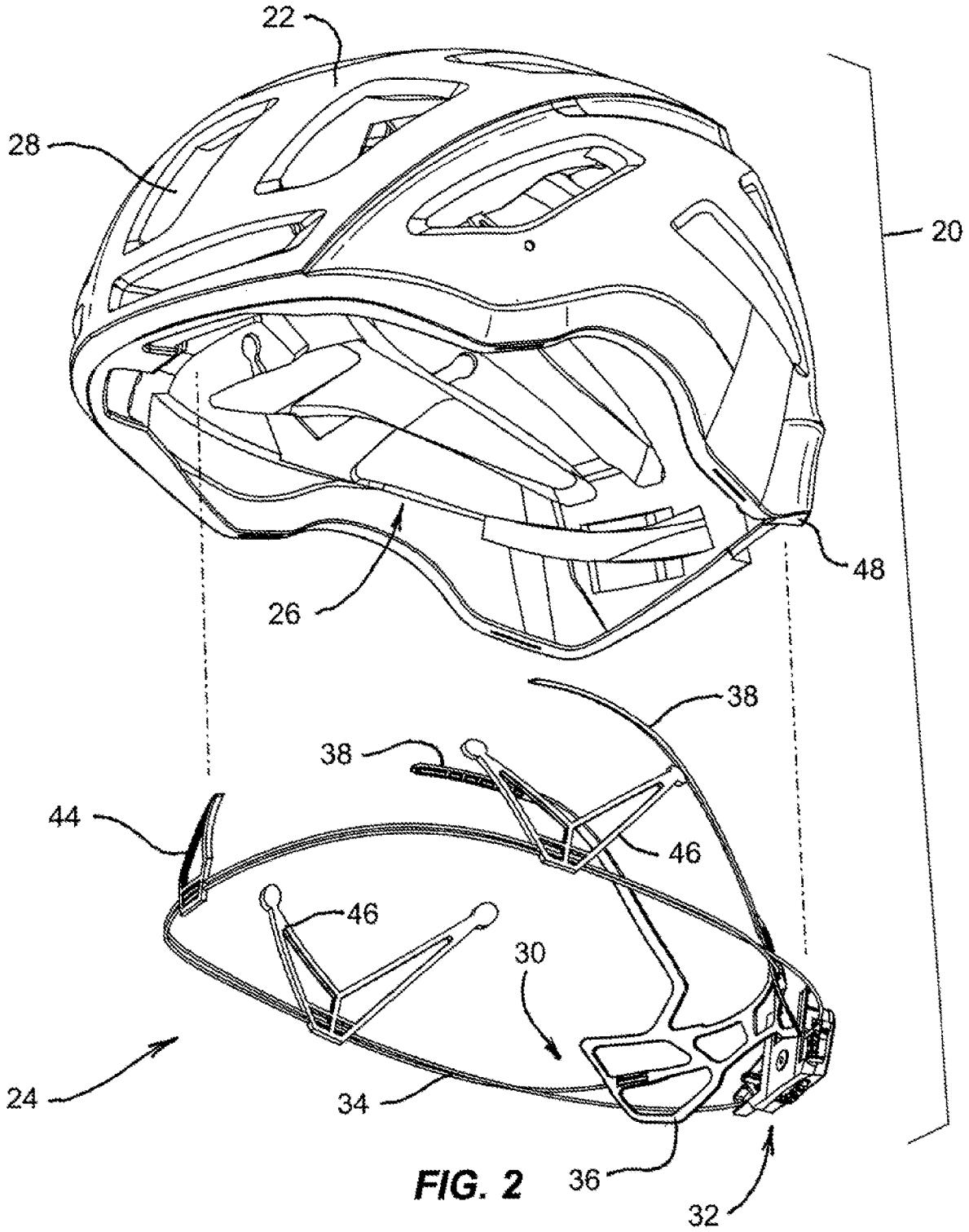
FIG. 2 is the perspective view of the helmet of FIG. 1 with a suspension assembly exploded away from a main body.
Figure 3:
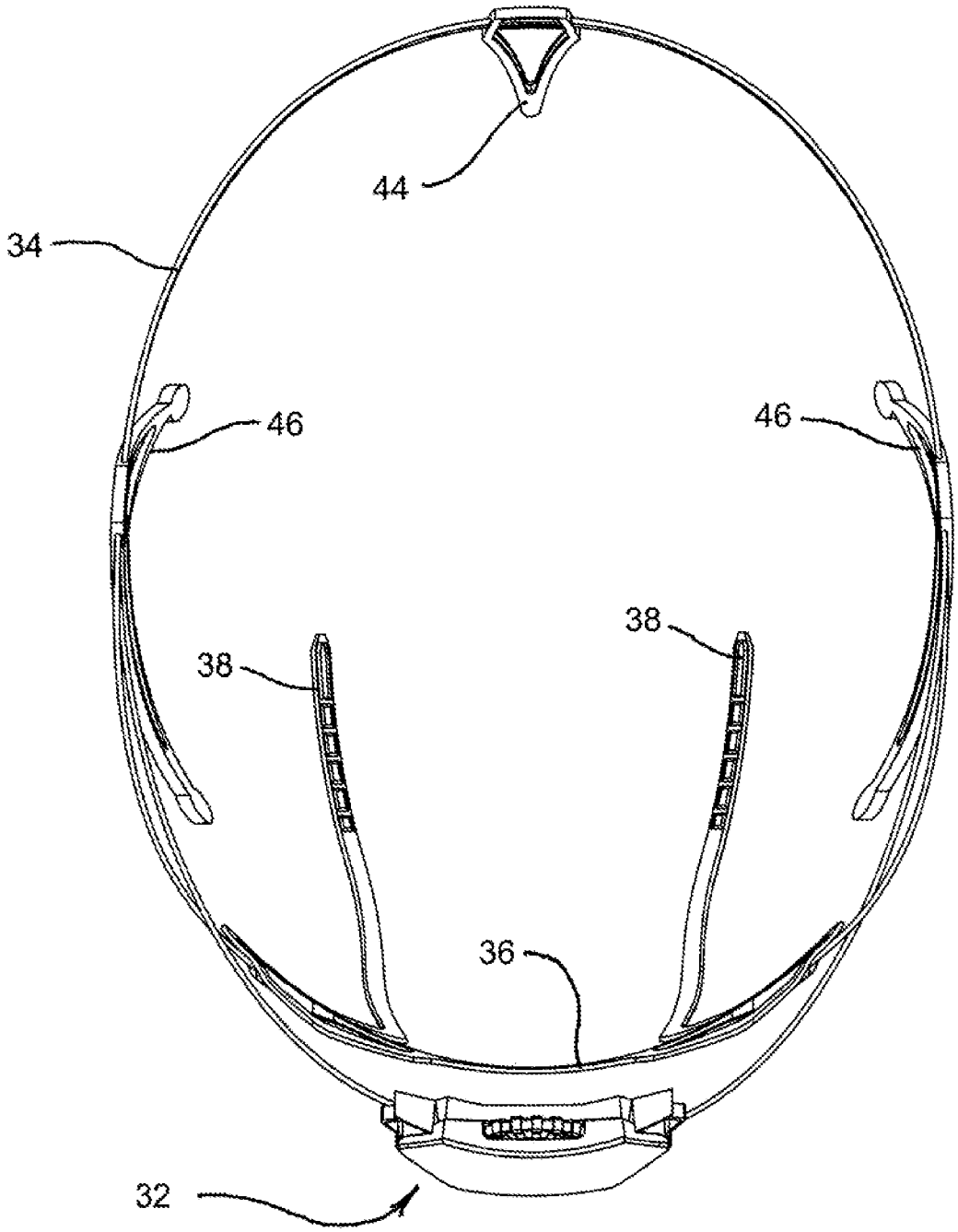
FIG. 3 is a bottom view of the suspension assembly of FIG. 2.
Figure 4:
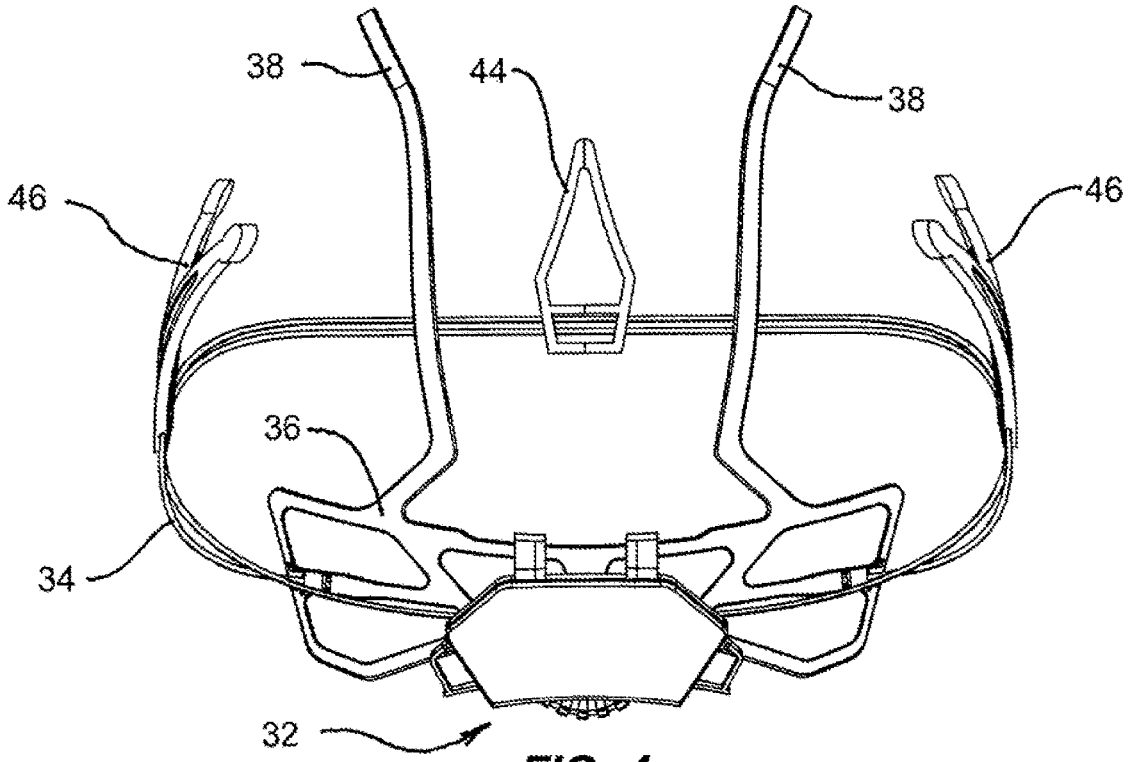
FIG. 4 is a rear view of the suspension assembly of FIG. 2.

FIG. 1 illustrates a helmet 20 comprising a main body 22 and a suspension assembly 24 mounted inside the main body 22. The main body 22 includes an occipital region and defines a concave interior 26 adapted to receive a user's head. The main body 22 is made from a hard foam (e.g., a closed cell expanded polystyrene (EPS) foam) covered by a hard polymer skin, as is known in the art. The main body 22 includes several cooling channels 28 that facilitate the flow of air through the helmet 20.

The suspension assembly 24 includes a head strap 30 and an adjustment mechanism 32 for adjusting the size of the head strap 30. The illustrated head strap 30 includes two flexible belts 34 and an occipital pad 36. One of the belts 34 is secured to one side of the occipital pad 36 and the other belt is secured to the opposing side of the occipital pad 36. The belts 34 then travel in opposite directions around the concave interior 26 of the main body 22 and terminate at the rear of the helmet body. Each of the belts 34 is a thin flexible member, such as nylon. Due to the described arrangement, it can be seen that the head strap 30 overlaps itself around a majority of the helmet 20.

The occipital pad 36 is positioned to contact the occipital portion of the user's head. The occipital pad 36 includes two arms 38 that extend upwardly and forwardly to suspend the occipital pad 36 from an upper portion of the main body 22. Specifically, each of the arms 38 is inserted into and engaged with a tunnel 42 molded into the hard foam of the main body 22.

The suspension assembly 24 further includes a front belt guide 44 and two side belt guides 46. Each of the belts 34 slides through each of the belt guides 44, 46 in such a manner that the belt guides 44, 46 serve to guide and position the belts 34 around a user's head. If desired, the belt guides 44, 46 can be provided with pads on an inside surface of each belt guide to increase the comfort of the suspension assembly 24 on a user's head.

Figure 5:
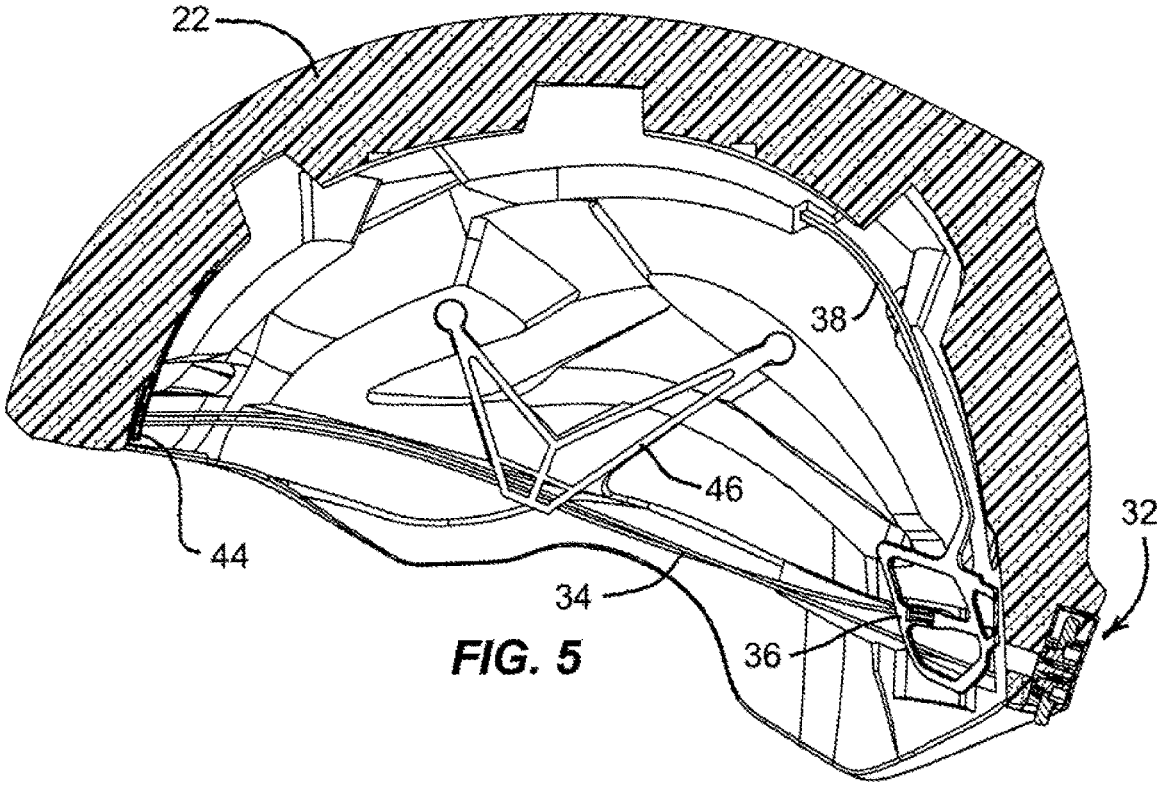
FIG. 5 is section view taken along line 5-5 in FIG. 1.
Figure 6:
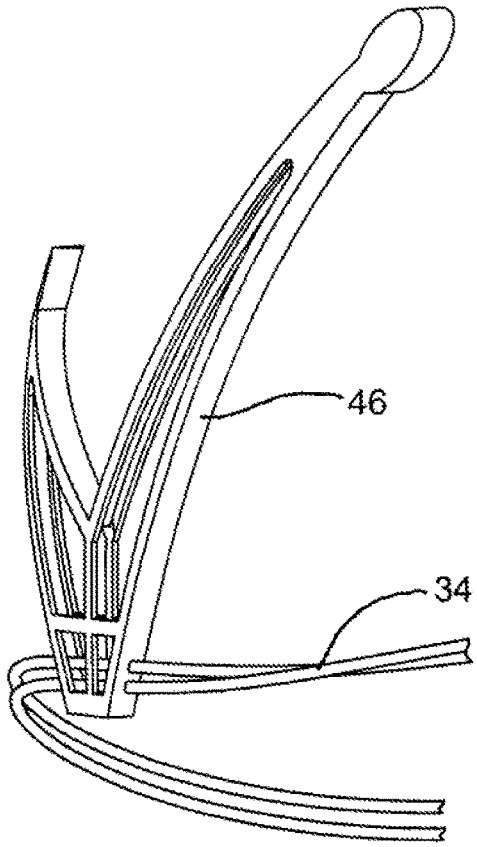
FIG. 6 is an enlarged view of a belt guide from the suspension assembly of FIG. 2.
Figure 7:
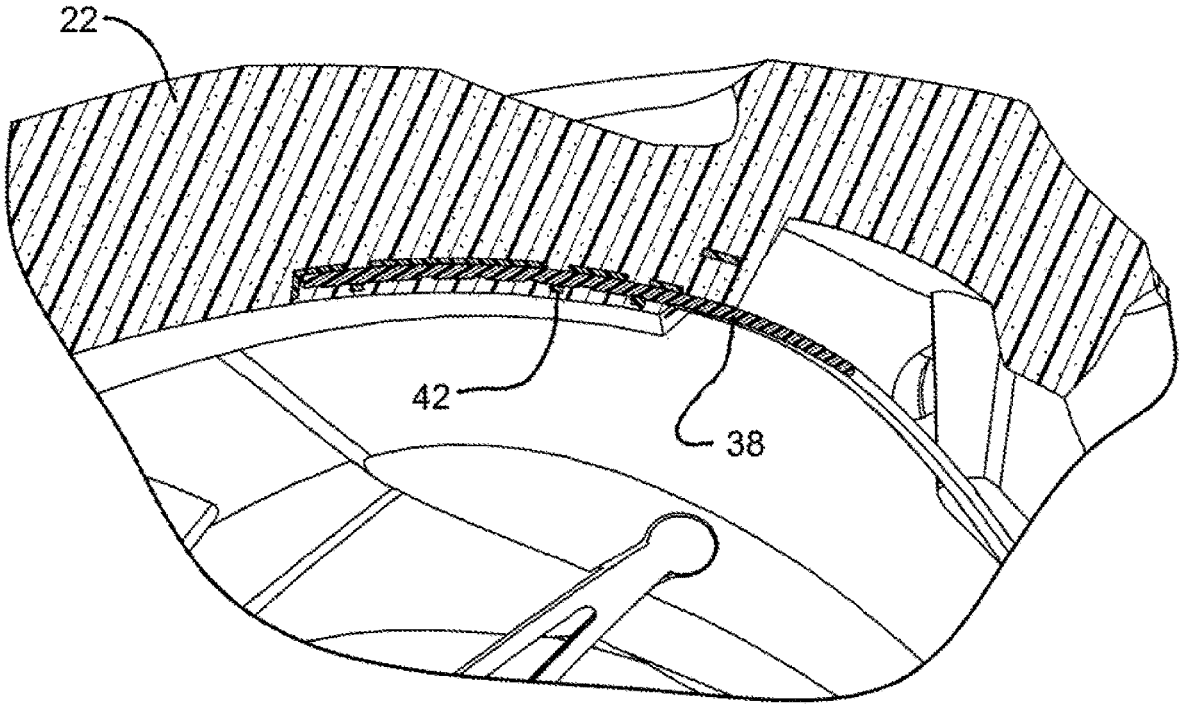
FIG. 7 is a section view taken along line 7-7 in FIG. 1.
Figure 8:
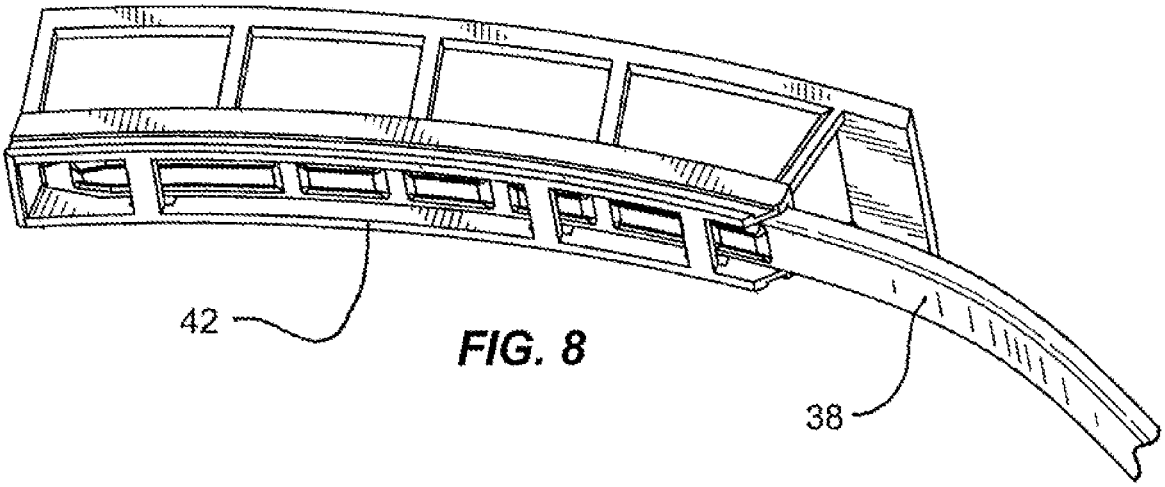
FIG. 8 is an enlarged view of FIG. 7.
Figure 9:
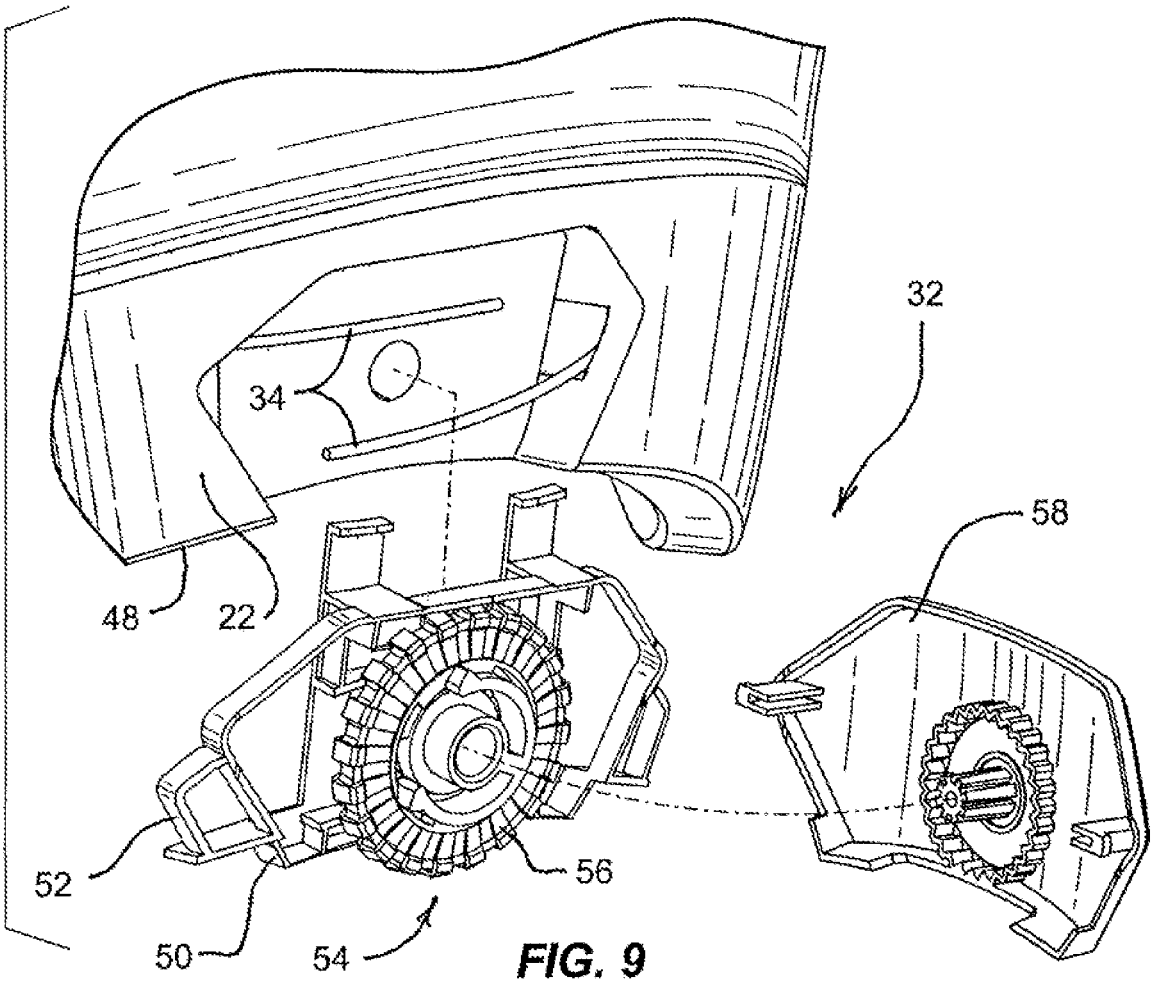
FIG. 9 is an exploded view of a gear box used in the helmet of FIG. 1.

The adjustment mechanism 32 is embedded in the hard foam portion of the main body 22 at a rearward, lower edge 48 of the helmet body. As shown in FIGS. 1 and 5, the adjustment mechanism 32 is positioned rearward of the occipital pad 36. Referring to FIG. 9, the adjustment mechanism 32 includes an inner cover 50 that is co-molded into the hard foam of the main body 22. The inner cover 50 includes outriggers 52 that are molded into the hard foam to hold the inner cover 50 firmly in place. The adjustment mechanism 32 further includes a ratchet mechanism 54 that engages an end of each of the belts 34 and, upon turning a dial 56, is adapted to move the ends of the belts 34 in opposition directions to either tighten or loosen the head strap 30. A ratchet mechanism suitable for this purpose is disclosed in U.S. Pat. No. 8,015,625, the entire contents of which is incorporated herein by reference. The adjustment mechanism 32 further includes an outer cover 58 that can be snapped onto the inner cover 50 to sandwich the ratchet mechanism 54 between the inner cover 50 and the outer cover 58.

It can be seen that the above-described suspension assembly 24 provides a head strap 30 that wraps substantially more than one time around a user's head. More specifically, one of the belts 34 starts at the adjustment mechanism 32, passes through a side belt guide 46, through the front belt guide 44, through the other side belt guide 46, and terminates with a secure engagement with the occipital pad 36. The other end of the occipital pad 36 is secured to the other belt, which travels through one of the side belt guides 46, through the front belt guide 44, through the other side belt guide 46, and terminates back at the adjustment mechanism 32. In this manner, it can be seen that the head strap 30, which includes the two belts 34 and the occipital pad 36, wraps more than one and a half times around the user's head.

It will be readily understood by one of ordinary skill in the art that the size of the helmet 20 can be adjusted by rotating the dial on the adjustment mechanism 32. Such rotation of the dial moves the ends of the belts 34 in opposite directions relative to each other to effectively increase or decrease the overall length of the head strap 30. During such adjustment of the head strap 30, the belts 34 are permitted to slide through the belt guides 44, 46 to facilitate smooth adjustment to the size of the helmet 20.

Various features and advantages of the invention are set forth in the following claims.

The invention claimed is:

1. A helmet comprising:

a main body having a concave interior for receiving a user's head;

a head strap coupled to the main body, the head strap forming a continuous loop and having a first flexible belt and a separate, second flexible belt;

a first side belt guide and a second side belt guide, wherein the first flexible belt passes through the first side belt guide and the second side belt guide, and wherein the second flexible belt passes through the first side belt guide and the second side belt guide; and an adjustment mechanism coupled to the head strap wherein the head strap includes an occipital pad positioned at an occipital region of the main body, wherein the first flexible belt is secured to the occipital pad and the second flexible belt is secured to the occipital pad, wherein the first flexible belt is engaged with the adjustment mechanism, and wherein the second flexible belt is engaged with the adjustment mechanism.

2. The helmet as claimed in claim 1, wherein the second flexible belt overlaps the first flexible belt around at least 25% of a circumference of the concave interior.

3. The A helmet as claimed in claim 1, wherein the second flexible belt overlaps the first flexible belt around at least 50% of a circumference of the concave interior.

4. The helmet as claimed in claim 1, wherein the occipital pad is coupled to the main body.

5. The helmet as claimed in claim 1, wherein a portion of the first flexible belt is spaced rearward from the occipital pad, and wherein a portion of the second flexible belt is spaced rearward from the occipital pad.

6. The helmet as claimed in claim 1, further comprising a front belt guide, wherein the first flexible belt passes through the front belt guide, and wherein the second flexible belt passes through the front belt guide.

* * * * *